US006977586B2

(12) United States Patent
Martin et al.

(10) Patent No.: US 6,977,586 B2
(45) Date of Patent: Dec. 20, 2005

(54) ASSOCIATED ARTICLES IDENTIFYING SYSTEM

(75) Inventors: Brian W. Martin, Carp (CA); Jennifer A. Hartfield, Ottawa (CA); Robert D. McCulloch, Ottawa (CA)

(73) Assignee: Instantel Inc, Ontario (CA)

( * ) Notice: Subject to any disclaimer, the term of this patent is extended or adjusted under 35 U.S.C. 154(b) by 108 days.

(21) Appl. No.: 10/467,756

(22) PCT Filed: Feb. 13, 2001

(86) PCT No.: PCT/CA01/00155

§ 371 (c)(1),
(2), (4) Date: Nov. 19, 2003

(87) PCT Pub. No.: WO02/065421

PCT Pub. Date: Aug. 22, 2002

(65) Prior Publication Data

US 2004/0080419 A1 Apr. 29, 2004

(51) Int. Cl.[7] ..... G08B 1/08
(52) U.S. Cl. ..... 340/539.15; 340/539.22; 340/573.4

(58) Field of Search ..... 340/539.15, 539.19, 340/539.22, 539.23, 573.1, 573.3, 573.4, 340/572.1, 572.3, 572.8, 572.9

(56) References Cited

U.S. PATENT DOCUMENTS 6,144,304 A * 11/2000 Webb ..... 340/573.4
6,211,790 B1 * 4/2001 Radomsky et al. ..... 340/573.4

* cited by examiner

*Primary Examiner*—Jeffery Hofsass
*Assistant Examiner*—Daniel Previl
(74) *Attorney, Agent, or Firm*—Vidas, Arrett & Steinkraus, P.A.

(57) ABSTRACT

An article identification system relies upon correlating or "bonding" a detecting object with an identifying object on an auto-identification basis. Identification data is provided on an automated, high-reliability basis, without human control over the precise identification data that is transferred. On this basis a nursery infant-parent identifier system is provided whereby, when a detecting baby bracelet is brought into the presence of an identifying parent's tag, a reliable indication is provided as to whether the bracelet and tag have been previously bonded.

29 Claims, 9 Drawing Sheets

ASSOCIATED ARTICLES IDENTIFYING SYSTEM

FIELD OF THE INVENTION

This invention relates to mechanisms for associating related objects. More particularly, it applies to a system for associating a mother with her own baby in a maternity ward. It also applies to the location of luggage and the like from amongst a collection of similar articles.

BACKGROUND TO THE INVENTION

It is often required to identify articles as being associated with a related article. One example is luggage on a carousel that must be identified by its owner. Another example, which is used as the specific example herein, is the identification of a baby in a hospital maternity nursery with the baby's mother. A further similar application is the maintenance of contact between mineworkers who are assigned to be each other's "buddy" in a mine.

It is important in hospital nurseries to identify each infant with the highest degree of reliability. In particular, hospitals need to be assured that the newborn baby being presented to a mother for nursing is her own child.

It is known to provide infants and mothers in hospitals with tags in the form of identification bracelets. Such bracelets have been built that include electronic transmission elements that provide a specific identification that is associated with the bracelet. Such electronic bracelets, based on centralized signal reception and processing, have been used to monitor the presence of an infant or mother in a nursery or other room, the removal of an infant wearing such a bracelet from a nursery, and the presentation of an infant to its proper mother.

Such existing systems rely on room-mounted and doorway-mounted sensors that receive signals emitted by the bracelets and process data received from the bracelets in a central processor. By assigning differing, distinct signals to each bracelet, the presence of each bracelet, and each corresponding infant and mother, in a given area can be monitored by a central electronic control system.

A need exists for a system whereby objects may be associated with each other without reliance on a central processing system. Further, a need exists for a system wherein objects to be associated with each other can be assigned to each other in situ i.e., in each other's presence as in a birthing room. Further, such objects should preferably be assignable to each other on a versatile basis, i.e. any object from one set can be assigned or correlated to any object of a second set, and re-assigned but without loss of security.

It is known to provide tags for identifying luggage based on a system whereby the object-carried signal-emitting tag is matched with the locating scanner at the time that both these items are manufactured c.f. U.S. Pat. No. 5,798,693. Similarly, locating systems for lost golf clubs (U.S. Pat. No. 5,952,921) and lost golf balls (U.S. Pat. No. 6,011,466) have been proposed. It is also known to provide an office file locating system based on attaching individualized, signal emitting, tags to files and using an addressable scanner that can be set to receive and locate specific files according the signals emitted from the file tags c.f. U.S. Pat. No. 5,450,070. The contents of all of these referenced prior art patents are adopted herein by reference.

It is also known in an unrelated field for aircraft radar detection systems to scan the radar spectrum to detect whether an aircraft is being pulsed by a radar signal emitted from an external source, e.g. another aircraft radar or a ground-based radar. In this latter case the "signature" or signal profile of such radar pulses is classified and recorded by the radar detecting system for future reference and subsequent re-identification.

In all these cases, the correlation of the object and locator so that an identifying match can be established on a future encounter requires human intervention. A need exists for a correlation system by which a pair of objects in proximity to each other e.g., in situ can be associated with each other automatically, without any intervention other than by activation of the correlation process. A need also exists for systems by which, once such a correlation is established between objects that are initially versatile (in the sense of being capable of being matched with one or more of several, potential, partner objects), such objects have the capacity to become "bonded" or imprinted to a specific associated object or objects after a reset operation has cleared existing bonding and made the object available for re-bonding.

The present invention is directed to addressing the above objectives.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

According to the invention in one aspect, member objects from two sets of objects have the capacity to become "bonded" to each other by means of acquisition of information data by at least one object from one set, the detecting object, as to the identity of one or more members of the opposite set, the identifying objects. Once so bonded, the detecting object is able to sense through wireless means, and assess through identification means associated with, and preferably carried by, the detecting object, the presence of either a bonded, identifying object from the opposite set, or a non-bonded identifying object from such set, that is present within a predetermined range. The detecting object may then provide an indication as to whether the sensed object is a bonded or non-bonded object. The indication may be in the form of an audio or visual signal, or an electronic signal that is emitted for immediate display or long term storage elsewhere, or is sent for storage in a memory location. It may be either affirmative or negative, signifying whether the sensed, identifying object is one to which the detecting object has been previously bonded—a "match"—; or is an identifying object from the opposite set to which the detecting object has not been bonded—a "mismatch".

Thus the detecting object can optionally ignore the presence of a non-bonded object, emitting only affirmative signals when a bonded object is present. Or it may emit a signal in the presence of any candidate, preferably on an automatic basis, identifying object from the opposite set, providing an indication that the detected, identifying object is not a bonded object. As a further alternative, the system can carry-out both functions. And as a still further alternative, the system can provide an indication when a bonded identifying object that has previously been present with a predetermined range of the detecting object, the detecting range, has moved beyond such range. This feature may be combined with the other features to provide multiple classes of output for an encounter between a detecting object and an identifying object.

In a preferred application of the invention, the detecting object is selected from a set of radio, infra-red or ultra-sonic equipped detecting bracelets to be worn by infants in a hospital nursery. And the objects from the opposite set are radio, infra-red or ultra-sonic transmitting tags, e.g. bracelets, to be worn by a mother, or optionally, tags to identify parents, grandparents, the medication apparatus or the like associated with the infant in the hospital, or the doorway to a room or the like on a premises.

In the bonding process, objects to be bonded are brought into communication with each other, preferably in each other's presence, to permit the acquisition of identification data by an identification means carried by, or linked to the detecting object. Data is so provided to enable the detecting object to identify object(s) from the opposite set to which it is to be bonded. This data may be provided to the identification means by a variety of systems including radio or other wireless signals based on infra-red or ultra-sonic communication or the equivalent. Such means may also include a connection through wired circuit connection means. Further, the communication channel may be direct or may include intermediate communication elements, provided, however, that the identification means linked to the detecting object acquires the data by which a matching or mis-matching identification can be established.

Signals may be coded by their frequency, by frequency or amplitude modulations, by pulse modulation or by other known means. A signal receiving means is correspondingly associated with the identification means and detecting object. The identification means comprises a signal discrimination circuit that will decode the signal that carries the identification data.

Identification data employed in the bonding process may be based on providing the objects from the opposite set with individual, unique identification codes. Such codes, equivalent to serial numbers, may be provided to the identifying objects at the time of their manufacture. The identification data may also be the equivalent of a password provided by the detecting object, or by an intermediate bonding means that communicates with both the detecting object and opposite, identifying object(s) to be bonded. Once the password has been acquired, the bonded identifying object(s) use this password in transmitting their identification data. This password may be drawn from a register of possible passwords so that the transmitted password is unique to the bonded objects. Or the password may be generated randomly in a manner that ensures that the transmitted password is functionally unique. This transfer of identification data need not be a mutual exchange. The opposite identifying object need not receive data on the identity of the detecting object.

While a preferred application of the invention is the verification of relationships between proximate objects such as infants and parents in hospital maternity wards, the invention also has applications where it is desired to provide an out-of-range signal between associated objects. This may occur in cases where a traveller wishes to ensure that his/her laptop computer is not left behind, or as in mines where miners are expected to work as "buddies" who must always remain within a predetermined range of each other. A further application is to prevent children, pets or the elderly from wandering-off. In these applications, an indicating signal is provided when the bonded objects move beyond a predetermined, detecting range of each other. This signal may emitted automatically when the not-detected signal condition occurs.

In either class of application it is a feature of the invention that the objects to be bonded are initially "versatile". By "versatile" is meant that any object from one set, the detecting object's set, may become bonded with an object from the opposite set, the identifying object's set. The acquisition of identification data in the bonding procedure operates without human selection of the identification data that is to be acquired in respect of the bonded objects. In this manner, the risk of human error arising in the bonding process is minimized. Further, objects may be members of more than one paired set at the same time. For example, an object could serve as an identifying object, a parent tag, in one pair of sets with a baby's bracelet as the detecting object. At the same time the parent's tag may be equipped to serve as a detecting object with respect to a tag on a dedicated medical apparatus or special feeding bottles as the identifying object. In this manner, the parents can both be identified, and can in turn, identify dedicated objects with the certainty that no error is occurring.

The invention differs from prior art object locator systems by the capacity of initially versatile objects to become bonded to each other on the basis of identification data that is acquired in the identification process without human selection of the precise data being acquired. Bonding preferably occurs with the objects in each other's presence,—in situ—, at a location whereat the bonded objects will thereafter be associated with, e.g. connected or bonded to, articles or persons which are intended to be correlated. The invention, in a preferred aspect, also allows the bonding process to be re-established afresh, with full bonding versatility, upon effecting a reset to clear the prior bonded states of the respective, bonded, detecting and identifying objects.

A transfer of identification data necessarily occurs during a bonding period, established by activation of the bonding process. According to one variant of the invention all identifying objects within a bonding range during a preset, bonding period provide identification data to the detecting object, thus creating a multiple group of bonded objects. If only one identifying object is present, reception of its identification data can be used to close the bonding period. Alternately, the termination of the bonding period may be manually established by a user input or automatically established by the identifying object after, reception of identification signals from a pre-selected number of identifying objects. Following the conclusion of the bonding period, the detecting object and identifying object(s) from the opposite set may be, in one variant, exclusively bonded to each other. This is in the sense that, unless a new bonding procedure is activated by initiation of another bonding period, a detecting object will not bond with any other object from the set of identifying objects with which bonding would otherwise be possible. Alternately, the bonding period may be re-opened to effect further bonding and expand the class of bonded identifying objects.

Thus, the invention applies to selected members from two distinct sets. These sets contain members that are versatile in their capacity to be correlated with any object from the other set, i.e. to become "bonded" to one or more of such objects. Bonding occurs in conjunction with the transmission of automatically generated identification data. Bonded objects then have the capability to provide an indication preferably on an automatic basis, that distinguishes whether members from opposite sets, which are present within have moved within, or optionally have moved beyond, a predetermined, detecting range of each other are, or are not, members that have been previously bonded to each other.

In summary, from a further aspect, the following features may be present in a new system based upon the invention:

1) all objects are drawn from two respective sets of objects having the initial capability of being bonded, by a transmission of identification data, between objects from the opposite-set;
2) bonding occurs by an initial, bonding communication between objects of opposite sets by the acquisition through an identification means linked to one object, a "detecting object", of identification data for one or more identifying objects of the opposite set with which bonding is to be established; such bonding communication need not necessarily being effected by wireless means; preferably bonding occurs with the objects in each other's presence;
3) bond objects of opposite sets are capable of at least one-way wireless communication, either directly or indirectly, between each other to effect transfer of identification data when within a predetermined range of each other;
4) after bonding has occurred, the detecting object from one set can, by receiving wireless communication, determine if an opposite, identifying object from the other set is present within, or has moved beyond, a predetermined detecting range, (that is not locale specific) and can determine whether the identifying object is or is not a member that has been previously bonded to it; and
5) a reporting indication is emitted, preferably by the detecting object, after the detection procedure is complete, indicating whether the objects have been previously bonded and whether the opposite object has entered within or, optionally, withdrawn beyond the predetermined detecting range.

As further optional features 6) reset means may be provided by which after bonding has occurred such bonding is cleared to make the detecting object available to be rebonded afresh to any members of the opposite set;
7) attachment means may provided by which the objects may be attached to articles or people, and
8) objects may simultaneously be members of two sets, eg. serving as both detecting and identifying objects.

The foregoing summarizes the principal features of the invention and some of its optional aspects. The invention may be further understood by the description of the preferred embodiments, in conjunction with the drawings, which now follow.

DESCRIPTION OF THE DRAWINGS

Figure 1:
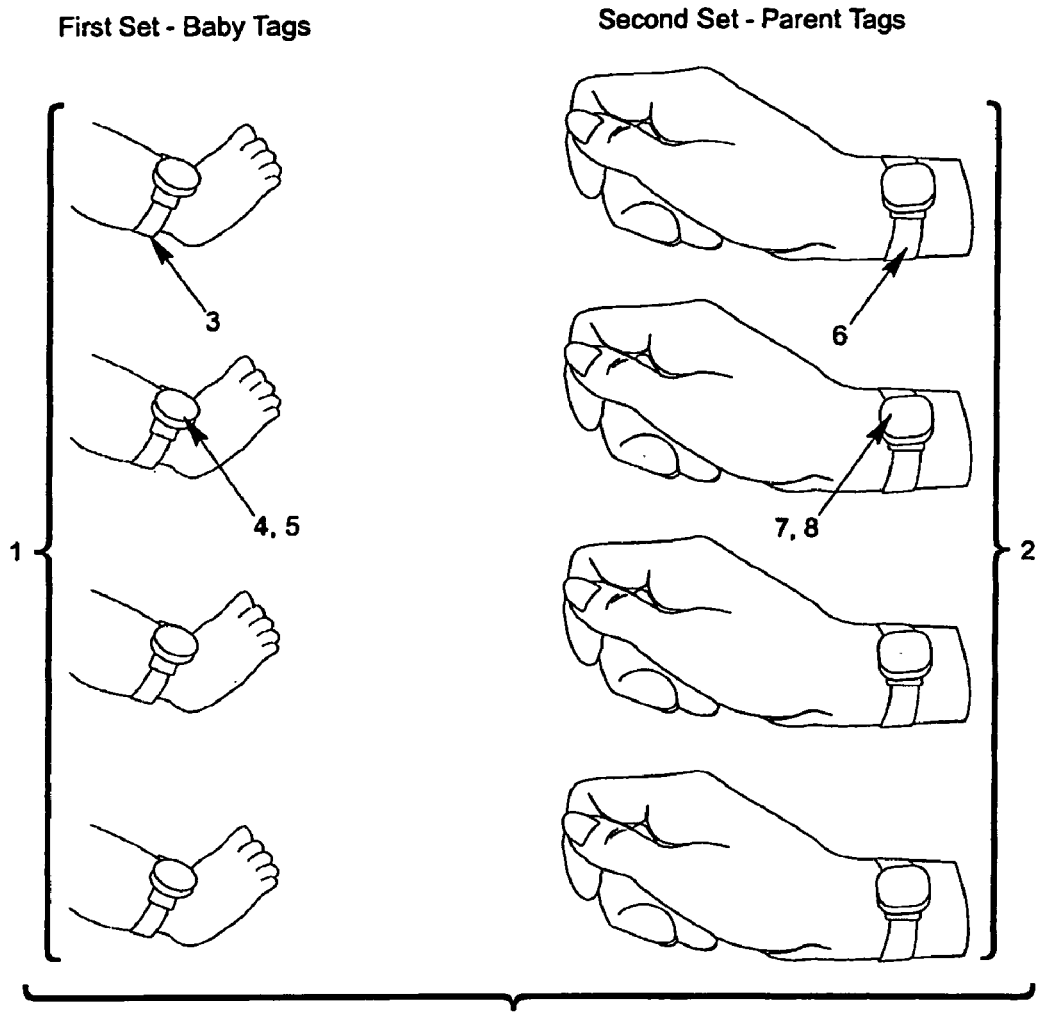
FIG. 1 depicts pictorially respective sets of baby bracelets and parent tags that are initially versatile in the sense that any member of one set can become bonded to a member of the other set.

In FIG. 1 a first set of objects 1 consists of individual baby ankle bracelets 3 having receiving 4 and optionally transmission 5, elements. A second set of objects 2 consisting of parent tags 6, optionally in the form of bracelets, provided with transmission 7 and, optionally reception 8, elements. Initially, any bracelet 3 of the first set may be correlated or "bonded" with any tag 6 of the second set 2.

Figure 2:
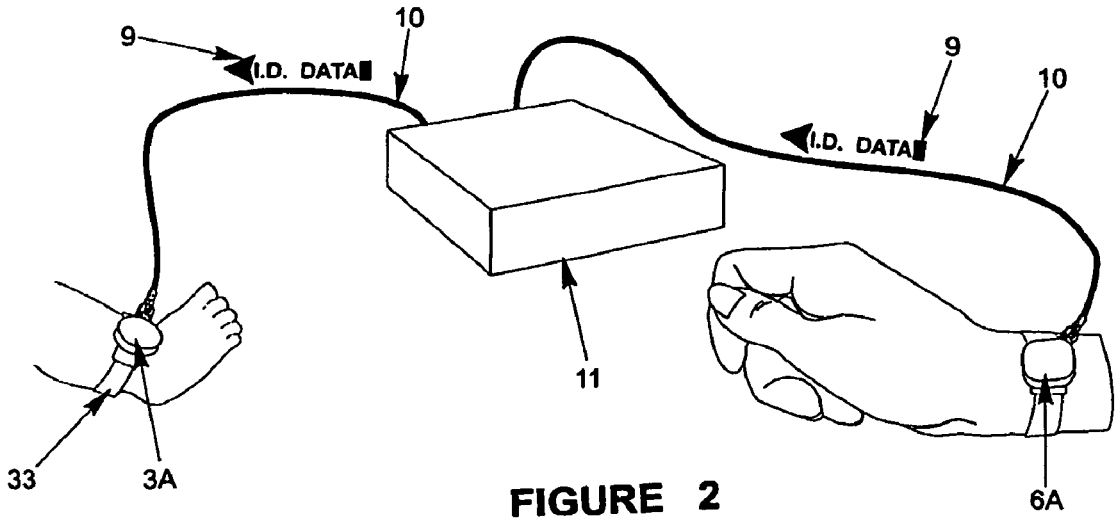
FIG. 2 depicts pictorially the selection of a single baby bracelet for bonding with a parent's tag through intermediate circuitry that permits the bracelet to store identification data unique to the bonded parent's tag.

In FIG. 2 the bonding process is depicted by which, in the case depicted, a specific tag 6A sends identification data 9 over wires 10 through linking circuitry 11 to a specific bracelet 3A. This "bonding" procedure may be initiated by closing the loop of a conductive strap 33 when a bracelet 3A is attached to a baby's limb. The bonding period following thereafter during which bonding may occur may be of a predetermined fixed length of time, may be manually terminated, or may conclude with the reception of one or more units of identification data 9. Where multiple parent tags 6 are present during the bonding period the baby's bracelet 3A may become bonded to such multiple parent tags 6 through serial or parallel access to the linking circuitry 11. Normally, all parent tags would provide unique identification data and the bracelet 3A would have the capacity to store multiple identities. As an alternative, through not preferred, multiple matched parent tags 6 could provide the same identification data 9. After communication of this data 9, the bracelet 3A will be able to distinguish the specific tag 6A, or tags, from the set 2 of tags 6. This constitutes the bonding process.

Figure 3:
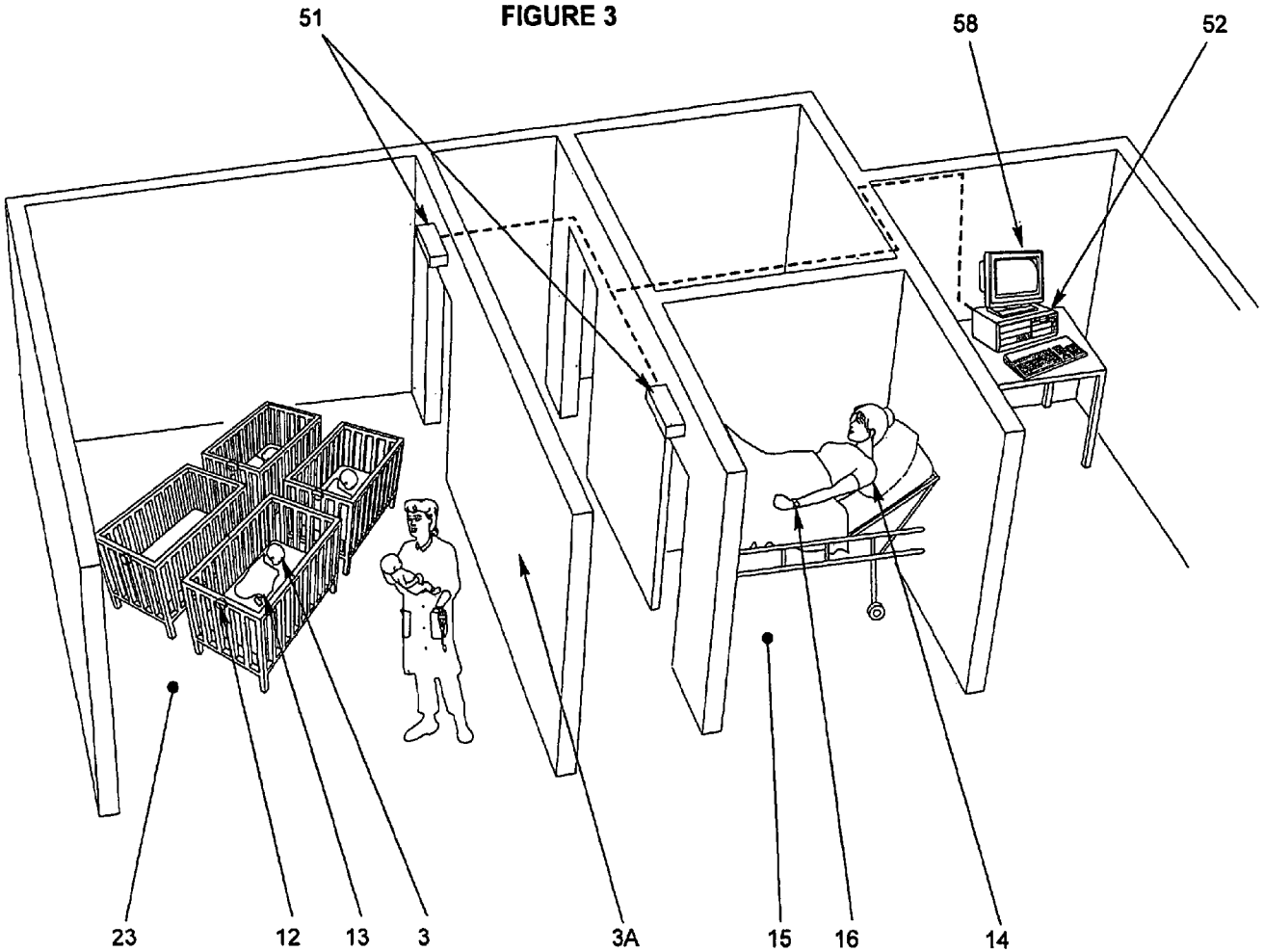
FIG. 3 is a pictorial overhead view of a hospital nursery with multiple infants carrying bonded bracelets, and mothers carrying bonded parent's tags located in hospital rooms beyond the range of detection and communication between bracelets and tags.

In FIG. 3 cribs 12 in a hospital nursery 23 contain infants 13 each wearing bracelets 3. Mothers 14 in bedrooms 15 wear individual parent's bracelets or tags 16. These parents tags 16 are equivalent to the tags 6 of FIG. 1. By reason of the distance separating the parent's tags 16 and baby's bracelets 3 in FIG. 3, and the short range of the transmitters 24 carried in the parent tags 16, the bracelets 3 in the nursery 23 are not able to detect the presence of the parent tags 16 in the hospital bedrooms 15.

Figure 4:
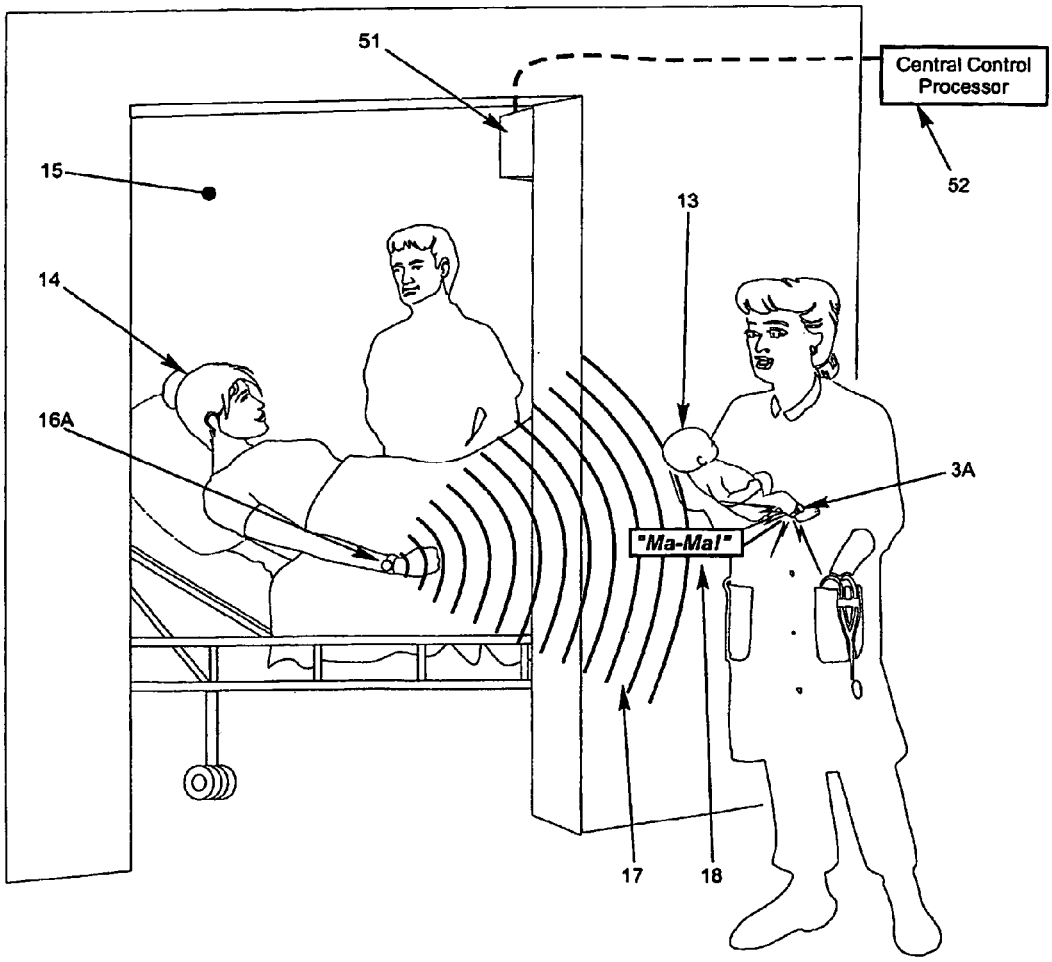
FIG. 4 depicts a single bonded bracelet on an infant as it enters the predetermined detection range of a correlated, bonded parent's tag in the form of a bracelet, worn by a mother, the baby's bracelet emitting an affirmative, matching signal.

In FIG. 4 a baby 13 wearing a previously bonded bracelet 3A is brought into the presence of a mother 14 wearing a similarly bonded parent's tag 16A. The parent's tag 16A emits repeated Very Low-Frequency—VLF radio signals 17 from its transmitter 24, which signals 17 are sensed by the bracelet 3A on entry into the detection range for the signals 17 present in the bedroom 15. VLF radio signals have a near field component that falls-off with distance as a cubic power of the distance, defining an effective limit to transmission range. Thus adjustment of the transmission power of the transmitters 24 in the parents tag 16A will establish a predetermined detection range based upon the threshold signal strength that a baby's bracelet 3A is able to detect. Alternate range detection means such as acoustic echo-location or electronic reflected wave, i.e. radar, or the equivalent may also be employed. In such cases, range evaluation circuitry would be included in the system. Using VLF radio signals of appropriately limited power, the signal 17 is not detectable by the bracelet 3A significantly beyond the entrance to the mother's room 15.

Within the room 15 and the range of the VLF signal 17, the bracelet 3A detects the signal and the identification data 9 of the parent's tag 16A—previously exchanged in the bonding procedure. The bracelet 3A may then emit, at least for a period of time, an audible signal 18 indicating that a match exists between the bracelet 3A and tag 16A. Preferably, this signal occurs automatically without human intervention. Similarly a match indicating light (not shown in FIG. 4, see FIG. 8) may be illuminated. If the bracelet 3A also carries a bracelet transmitter 34, an event report may be emitted by radio or infra-red transmission for reception by a building-mounted receiver 51 for transfer to a remotely located central control processor 52. At the control site, the event may be presented, e.g. displayed on a video monitor 58 or recorded for later reference. If the mother's tag 16A contains a receiver it may provide the matching/non-matching indication. All of these outputs constitute output indications of the events that have occurred.

In FIG. 4, once a match has been established, the indication signal may be suspended, as by a time-out shut-off circuit within signal indication means 32. This signal may be reactivated if the baby bracelet 3A is moved beyond the detection range e.g. out of the room 15. Short interruptions in the ongoing reception of identification data 9 may be accepted without re-emitting a match-signal in order to accommodate temporary disruptions in inter-bracelet communications. Such interruptions could arise from antennae misalignment, or from the presence of an intervening, blocking object between the bracelets 3A,16A.

Figure 5:
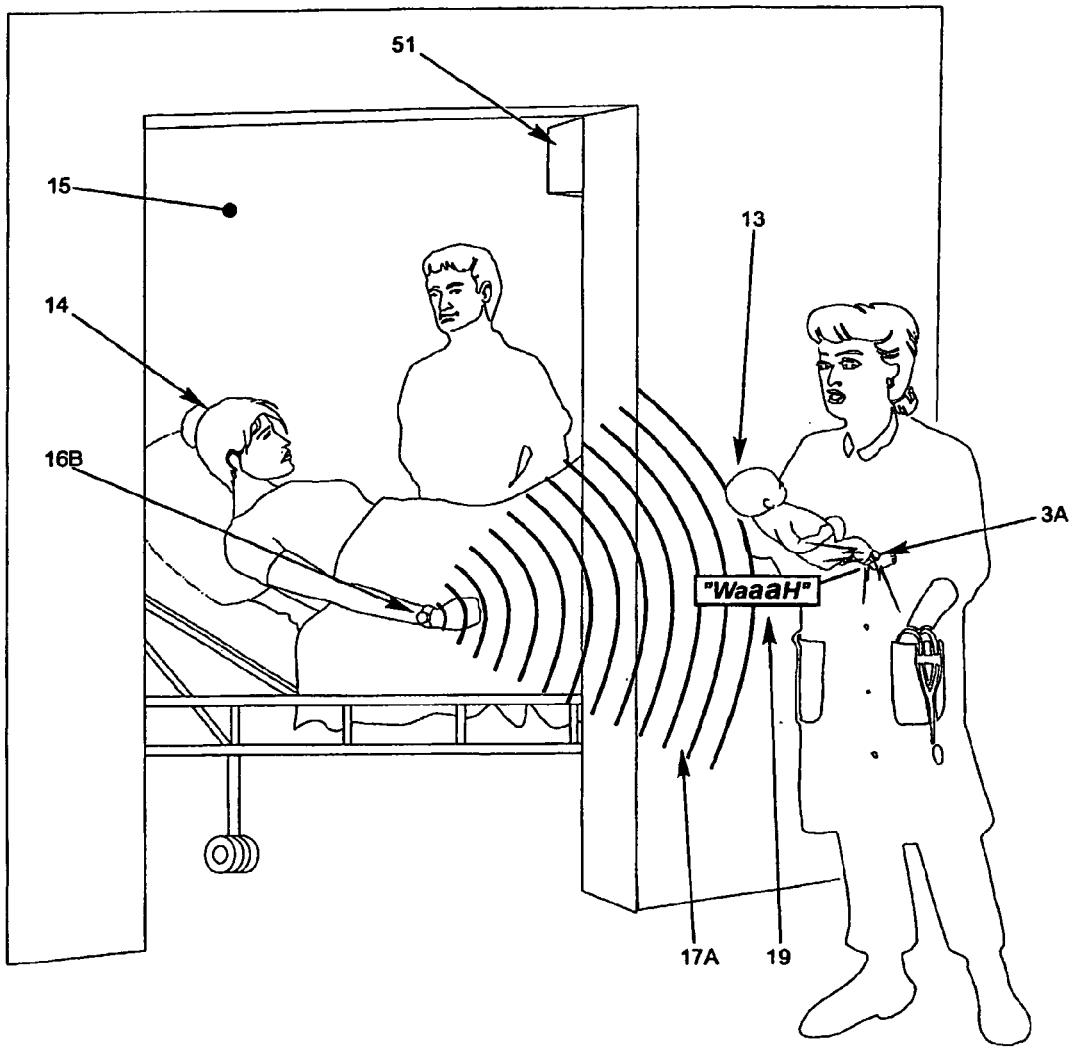
FIG. 5 corresponds to FIG. 4 wherein the bracelet, upon approaching within the detecting range of a mother's tag to which it has not been bonded emits a non-matching warning signal.

In FIG. 5 the same scene is depicted wherein the bracelet 3A and parent's tag 16B are not a match, and the VLF signal 17A contains a non-matching identification code. A corresponding non-matching alert indication 19 is emitted by the bracelet 3A. This may be an alternate or cumulative feature to those depicted in respect of FIG. 4. Again, other output indications may also arise from such an event.

Occasions may arise where more than one matching infant-parent sets are all within inter-tag detection range of each other. In such cases, the detecting object 3A may not only have a time-out limit to signal emission but may contain circuitry to suppress emission of a mismatch signal 17A so long as a matching signal 17 is being received. Optionally, a momentary mismatch signal 17A may be produced by such circuitry, followed by suppression of further signals.

Figure 6:
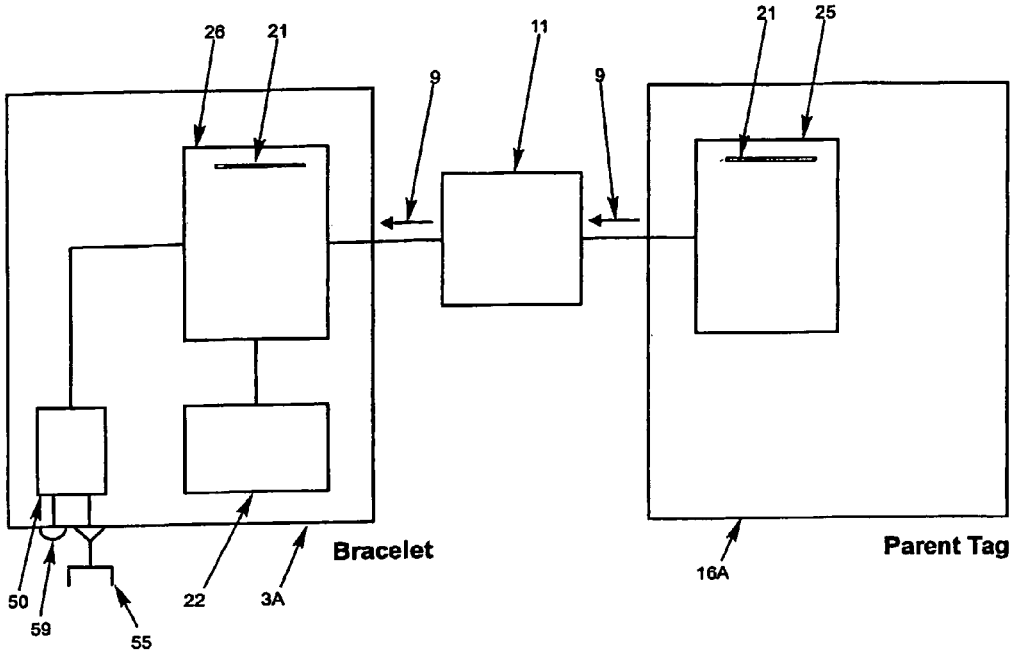
FIG. 6 is a block diagram depiction of the functional elements of a baby's bracelet and parent tag as they are interconnected during the bonding procedure depicted in FIG. 2 whereby the parent tag originates the identification data.

In FIG. 6 one variant of the bonding process is depicted. In FIG. 6, the tag 16A has a stored identification code 21, akin to a serial number, available in a parent tag memory 25 to transmit during bonding. In this case once the bonding process has been initiated e.g. by activation of an initiate-bonding circuit 50 through a button 59 or antenna 55 which receives an activation signal, the bracelet 3A receives the identification signal 9 through the linking circuitry 11 from the tag 16A. The identification code 21 in this case originates from the parent tag 16A. On reception by the bracelet 3A, the code 21 is stored in a bracelet memory 26 accessible by comparison circuitry 22, both of which are located within the bracelet 3A. The comparison circuitry 22 is subsequently employed to assess signals received from further identifying tags 16. This completes the bonding process.

Figure 7:
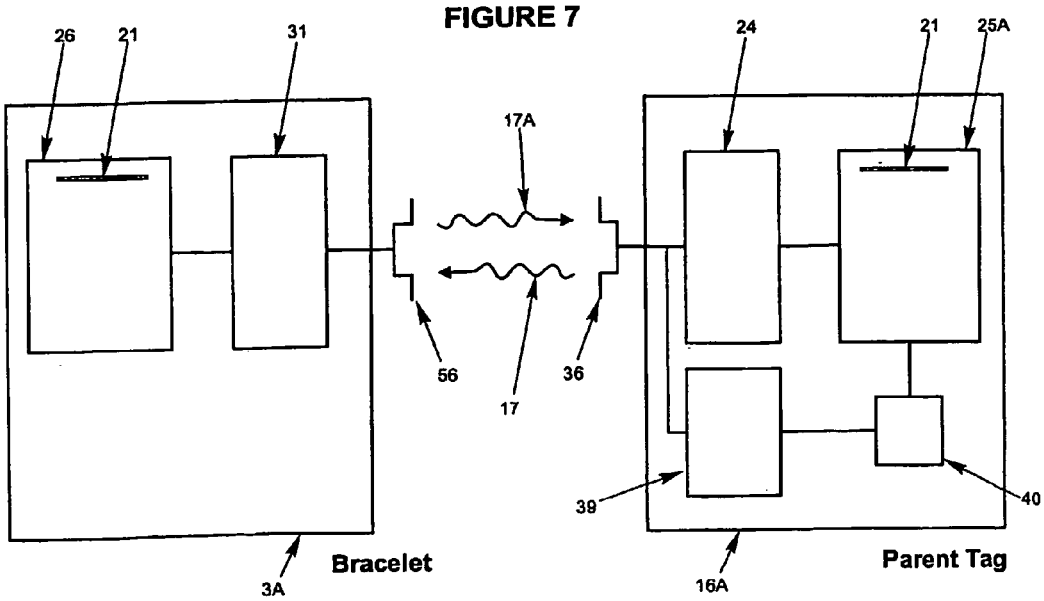
FIG. 7 corresponds to FIG. 6, modified to the case where the baby's bracelet originates the identification data and the parent tag stores and adopts such data.

In FIG. 7 an alternate bonding process is shown. Here the bracelet 3A receives one of the regular VLF signals 17 issuing from the parent tag 16A by emission from the parent tag transmitter 24 through an antenna 36. However, this initial signal does not include an identification code which is specific to the parent tag 16A. Instead, when the bonding process is to be initiated (as above) the bracelet 3A provides such specific identification code 21 by a return radio frequency signal 17A emitted by a transmitter 31 through antenna 56. The parent tag 16A, which includes a receiver 39, decoder 40 and parent tag memory 25A, receives and stores this code 21 for subsequent re-transmission. The link for this alternate process need not, however, be wireless. Instead it could rely on directly wired, intermediate linking circuitry 11. Equally, the procedures of FIG. 6 could be carried-out by wireless means.

The bonding process may be initiated by electrically activating the baby's bracelet 3 to await the reception of identification data 9. This may be conveniently effected by providing the bracelet 3 with a conducting strap 33 that closes an electrical circuit when the strap 33 forms a loop around a baby's limb.

Once the bonding process is initiated, the bracelet memory 26 may be made accessible for only a limited period of time. This establishes a bonding period during which, and only during which, the initial bonding communication may be perfected until a reset occurs. Alternately, the bracelet 3A may contain circuitry akin to circuitry 50 allowing the bonding period to be re-opened and allow further bonding to be extended to additional parent tags 16. As a further alternative, the bonding period may be kept open until identification data 9 has been received from one, or a predetermined multiple number of identifying sources.

To prevent the bonding period from remaining open indefinitely, as where staff are not organized to present an identifying object promptly, or neglect to do so, the bonding window could close afer a predetermined interval. Thereafter, a fresh activation procedure would be required to reopen the bonding window.

Figure 8:
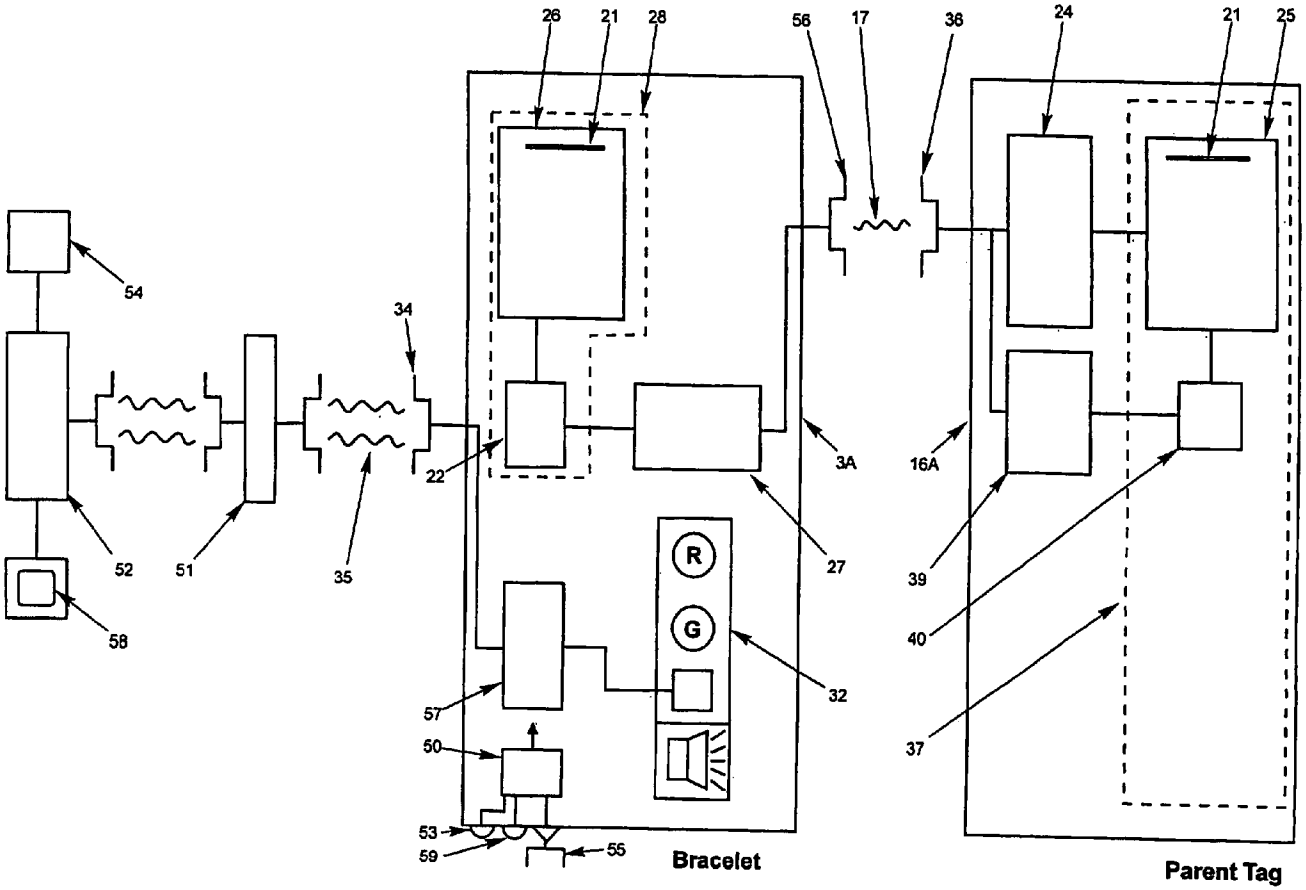
FIG. 8 is a block diagram depiction of the functional elements of a bonded pair of baby's bracelet and parent tag as they come within range of each other as depicted in FIG. 4 with provision for the baby's bracelet to send signals to a central processor and monitoring station.

In FIG. 8 the functional elements within a bonded pair of baby's bracelet 3A and parent tag 16A are shown, operating as they would when the bracelet 3A comes within range of the coded VLF radio signal 17 that is being emitted by the parent tag 16A. The bracelet 3A contains the following components: a VLF receiver 27; an antenna 56; a microprocessor 28 connected to the baby bracelet memories 26 and computer identification comparison circuitry 22; actuating input means e.g. button 59 to initiate bonding (which may be coupled to the mounting of a strap 33); a reset input means 53 to reset and purge bonding; and signal indication means 32 to provide match and/or mis-match signals optionally the bracelet 3A may include a radio transmitter 57 and antenna 34 to provide a radio output indication 35 to a remote, centralized processor 52 and otherwise communicate with such processor 52.

The parent tag contains the following components: a VLF transmitter 24; VLF antennae 36; a microprocessor 37 with access to the parent tag memories 25; an optional receiver 39, and decoder means 40 accessible by the microprocessor 37.

These elements all interact in the manner as described above or as will be implicit in the functionalities of the invention herein.

Figure 9:
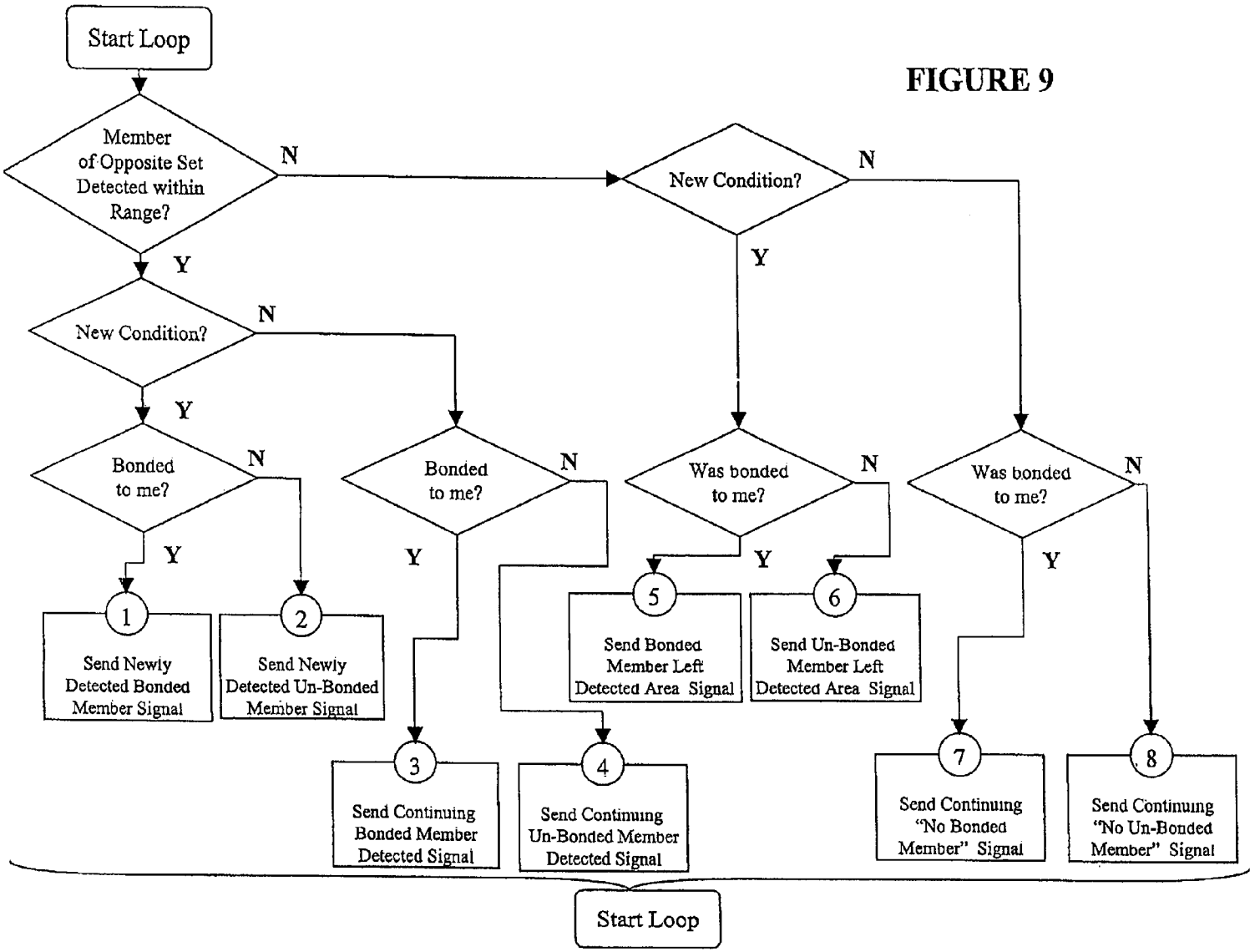
FIG. 9 is a logic flow chart showing signal condition analysis for the multiple cases of detection of objects, bonded and not bonded, coming within the detecting range and an object moving beyond the detecting range.

FIG. 9 depicts the logic flow analysis that may be executed by the computer circuitry 22 contained within the bracelet 3A. Both bonded and non-bonded objects from the opposite set may come within range. The logic flow analysis of FIG. 9 establishes the type of output, signal that the indication means 32 provides.

Figure 10:
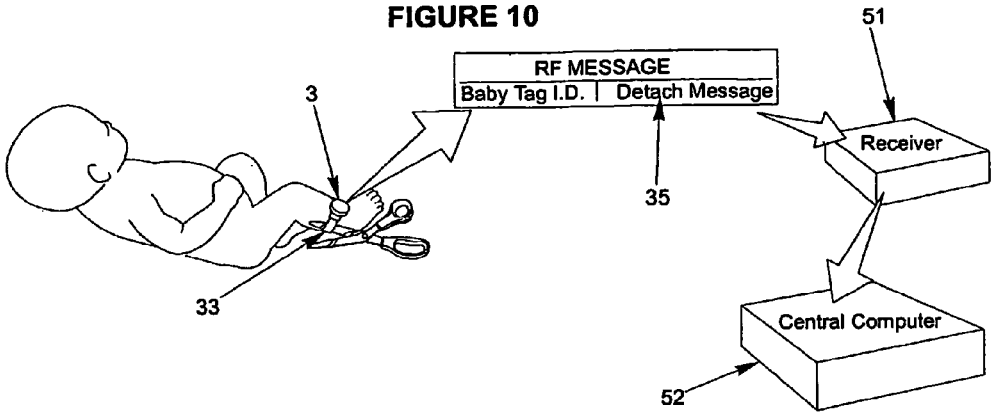
FIG. 10 depicts the deactivation of a bonded baby's bracelet by the severing of the attachment strap of the bracelet.

The system preferably incorporates a means akin to and/or incorporated into activation means 50 by which the bonded state may be deactivated or purged, allowing a reset following which a bracelet 3A may be freshly bonded to a new parent tag 16 by a reinitiation of the bonding procedure. Deactivation may conveniently be precipitated by a button 53, or by severing, as in FIG. 10, a bracelet strap 33 which carries an electrical link to circuitry within the bracelet 3A. This is depicted in FIG. 10. Installation of a fresh strap 33 may then act equivalently to button 59 to reinitiate the bracelet's 3 computer circuitry and permit a fresh bonding operation to occur.

This deactivation process may be subject to a delay or "time-out" period during which a loosened or momentarily disconnected strap may be reattached. Such an event would normally be monitored by a central processor as discussed below.

While the foregoing description applies to autonomously operating sets of objects, as a collateral feature, an external signal monitoring system may also be employed.

The bracelets of the invention may be employed in conjunction with a series of fixed local area receivers 51 that connect to a central processor 52 and display facility 58. Existing systems monitoring infant location which rely on radio and infra-red signal detectors 51 receive and process identification signals emitted from bracelets 3 and tags 16 present within the range of such detectors 51. In the present invention the centralized processor 52, operating in parallel with the direct tag-to-tag wireless communication between parent tags 16 and infant bracelets 3 that are within inter-tag detection range of each other, may be sent, as shown in FIG. 8, a signal 35 that corresponds to, with or without additional data, the signal 17 received by the bracelet 3A. The centralized processor 52 can then log the event that has occurred, and display, through the display facility 58, what type of encounter is occurring. When a mis-match is registered corrective action may be taken by hospital staff. The central processor 52 may also store in a memory 54 a record of such encounters for archival purposes.

The period or duration of the encounter, or the absence of an encounter, can be monitored and an alert signal may be provided by the processor 52 when a predetermined period of permissible delay has been exceeded. Thus where breastfeeding is to occur on a regular scheduled basis, the central processor 52 could provide a warning that such breastfeeding is overdue based on the absence of an expected encounter between a baby 13 and its mother 14. The central processor 52 may also store in a memory 54 a record of such encounters for archival purposes.

In premises with restricted access areas the location of matching tags may be monitored through portal-mounted devices 51, which initiate signals when a match set of tags 3A, 16A are entering a restricted area such as a smoking room. Appropriate action may then be taken.

A centralized processor 52 can also participate in the initiation of a bonding event. For example, when intermediate bond circuitry 11 is employed, such circuitry 11 may require a password authorization to be keyed-in, and the centralized processor 52 can assess the keyed-in data and send a signal through activation antenna 52 to enable the bonding process to proceed.

As a further control function that may be exercised by the central processor 52, bonding may only be enabled when the objects to be bonded are present at a specific locale, e.g. a birthing room. The portal-mounted devices 51 may be used to sense the entry of the objects to be bonded into the specific locale. The central processor 52 may then send a signal to such specific devices (or one of them) permitting bonding to proceed.

Figure 11:
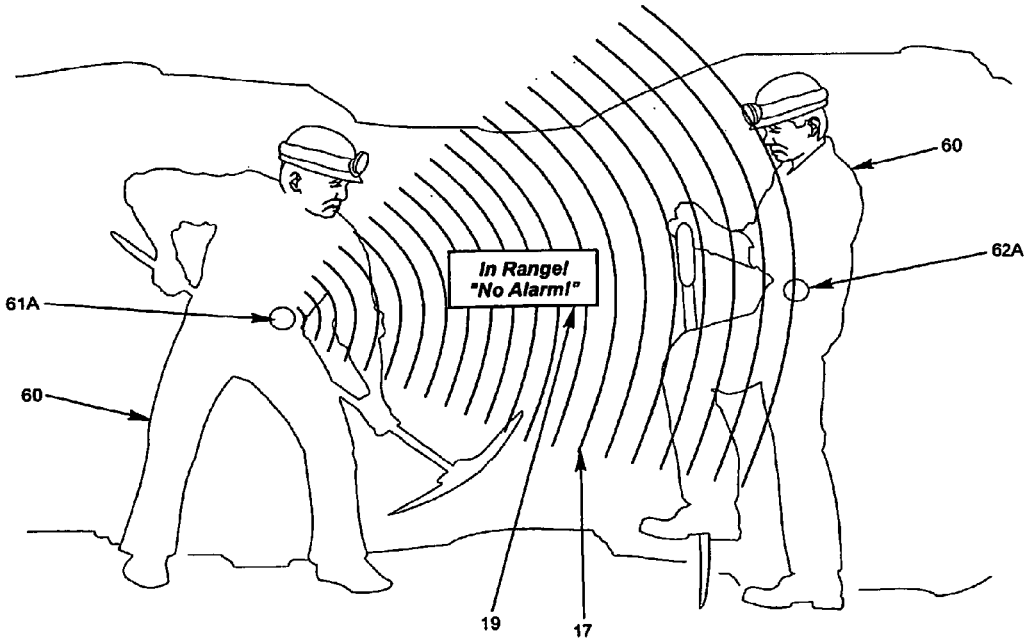
FIG. 11 depicts two mine workers active within range of each other.
Figure 12:
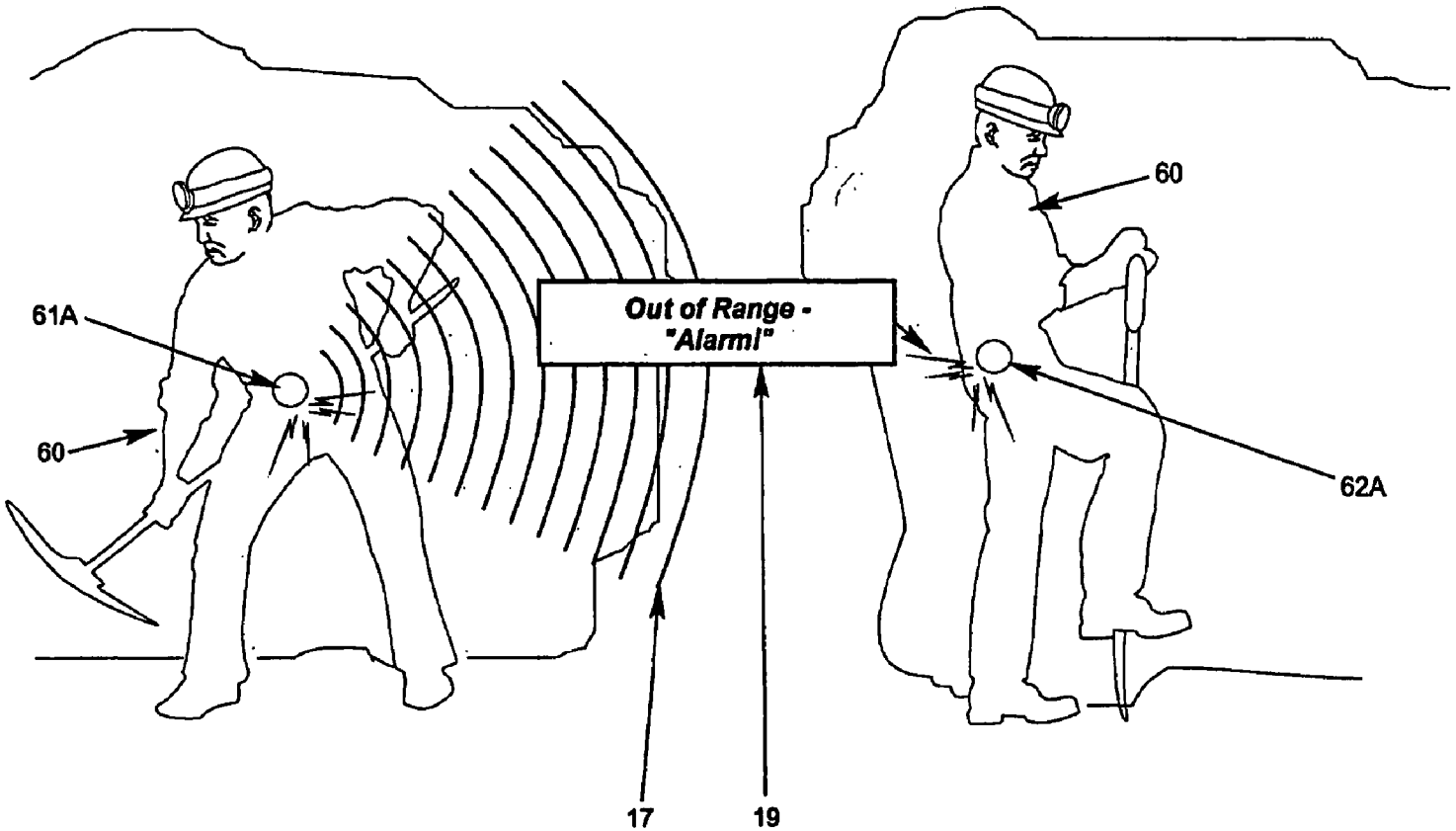
FIG. 12 depicts the departure of one mine worker beyond range leading to emission of an out-of-range alarm signal.

FIGS. 11 and 12 depict the moving-out-of-range scenario, using mine buddies as the example. Miners 60 carry respectively an identifier tag 61A and detecting tag 62A, corresponding to a parent tag 16 and baby's bracelet 3. These tags 61A,62A have been bonded to each other, as indicated by the letter "A" as by any of the manners described above.

When within range of the signal 17 as shown in FIG. 11, no signal 19 is emitted. When the miners 60 move beyond the range of the tags 61A,62A an out-of-range alarm signal 19 is emitted.

These miner's tags 61A,62A are versatile in the sense that before becoming bonded, they are drawn from respective sets wherein any member of one set can be bonded to any member of the other set. This greatly facilitates the inventorying of these locator tags.

CONCLUSION

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property or privilege is claimed are defined as follows:

1. An associated articles identification system comprising:

at least one radio tag from a first set of radio tags, each radio tag from said first set of radio tags being locatable proximate to an article from a first set of articles;

at least one radio tag from a second set of radio tags, each radio tag from said second set of radio tags being locatable proximate to an article from a second set of articles;

wireless communication means within each said radio tag of said first and second set of radio tags, whereby said wireless communication means allows communication between said first set of radio tags and said second set of radio tags;

range detection means within at least one of said first set of radio tags and said second set of radio tags, said range detection means detecting whether a radio tag from said first set of radio tags is within a predetermined range of a radio tag from said second set of radio tags;

a unique identifier within at least one of said first set of radio tags and said second set of radio tags, said unique identifier being transmitted using said wireless communication means;

in situ bonding means between at least one radio tag of said first set of radio tags and at least one radio tag of said second set of radio tags, said bonding means including:

activation means to begin a bonding process;

storage means to store said unique identifiers received during said bonding process; and deactivation means to end said bonding process;

whereby said at least one of first set of radio tags becomes bonded to said at least one of said second set of radio tags for which said unique identifier was received;

identification means within at least one of said first set of radio tags and said second set of radio tags, said identification means determining whether a first radio tag from said first set of radio tags is bonded to a second radio tag from said second set of radio tags when said first radio tag is within a predetermined range of said second radio tag; and indication means within at least one of said first set of radio tags and said second set of radio tags, said indication means providing an indication of whether said identification means determined that said first radio tag is bonded to said second radio tag, whereby said indication means provides a different indication if said first and second radio tags are bonded than if said first and second radio tags are not bonded.

2. The system as in claim 1, wherein said wireless communication means does not allow communication between radio tags of said first set of radio tags.

3. The system of claim 1, wherein said wireless communication means does not allow communication between radio tags of said second set of radio tags.

4. The system of claim 1, wherein said at least one radio tag from said first set of radio tags is affixed to said article from said first set of articles.

5. The system of claim 4, further comprising a tamper detection system, said tamper detection system triggering if said at least one radio tag from said first set of radio tags is removed from the article that said radio tag is affixed to.

6. The system of claim 5, fitter comprising a security system, said security system creating an alarm if said tamper detection system is triggered.

7. The system of claim 4, further comprising a tamper detection system, said tamper detection system triggering if said at least one radio tag from either said first set of radio tags or said second set of radio tags is removed from said article said radio tag is affixed to.

8. The system of claim 4, wherein affixing said radio tag from said first set of radio tags to the article that said radio tag identifies activates said activation means within said bonding means.

9. The system of claim 8, wherein said radio tag from said first set of radio tags is affixed to said article from said first set of articles using a conductive strap.

10. The system of claim 1, wherein said at least one radio tag from said second set of radio tags is affixed to said article from said second set of articles.

11. The system of claim 10, further comprising a tamper detection system, said tamper detection system triggering if said at least one radio tag from one second set of radio tags is removed from the article that said radio tag is affixed to.

12. The system of claim 10, wherein affixing said radio tag from said second set of radio tags activates said activation means within said bending means.

13. The system of claim 12, wherein said radio tag from said second set of radio tags is affixed to said article from said second set of articles using a conductive strap.

14. The system of claim 1, further comprising an erasing means, whereby said unique identifiers in said storage means are erased, thereby allowing a radio tag to be reused and form a different bond.

15. The system of claim 14, wherein said erasing means can only be activated if said first radio tag is not affixed to the article that said first radio tag identifies.

16. The system of claim 1 wherein said deactivation means ends the bonding process after receiving a single unique identifier.

17. The system of claim 1 wherein said deactivation means ends the bonding process after a predetermined time interval.

18. The system of claim 1 wherein said deactivation means ends the bonding process after the first of receiving a single unique identifier or expiry of a predetermined time interval.

19. The system of claim 1, wherein said article from said first set of articles is an infant.

20. The system of claim 19, wherein said article from said second set of articles is a mother.

21. The system of claim 20, wherein said indication means produces an affirmative indication if said radio tag of said infant is bonded to said radio tag of said mater and said radio tag of said infant is within said predetermined range of said radio tag of said mother.

22. The system of claim 20, wherein said indication means produces a negative indication if said radio tag of said infant is not bonded to said radio tag of said mother and said radio tag of said infant is within said predetermined range of said radio tag of said mother.

23. The system of claim 1, wherein said bonding means receiving no unique identifier before said deactivation means is triggered results in a radio tag that is not bonded to any other radio tag.

24. The system of claim 1, wherein said article from said first set of articles is a first electronic article.

25. The system of claim 24, wherein said article from said second set of articles is a second electronic article.

26. The system of claim 25, wherein said indication means produces an affirmative indication if said radio tag of said first electronic article is bonded to said radio tag of said second electronic article and said radio tag of said first electronic article is within said predetermined range of said radio tag of said second electronic article.

27. The system of claim 25, wherein said indication means produces a negative indication if said radio tag of said first electronic article is not bonded to said radio tag of said second electronic article and said radio tag of said first electronic article is within said predetermined range of said radio tag of said second electronic article.

28. The system of claim 1, wherein said range detection means comprises:

a wireless receiver within one of said first set of radio tags and said second set of radio tags, and a wireless transmitter within the other of said first set of radio tags and said second set of radio tags.

29. The system of claim 28, wherein said receiver is a very low frequency (VLF) receiver and said transmitter is a VLF transmitter and here said predetermined detection range is determined by the threshold detection of the near-field emissions of the VLF transmitter by the VLF receiver.

* * * * *